United States Patent [19]

Sokoloff

[11] Patent Number: 4,989,328

[45] Date of Patent: Feb. 5, 1991

[54] DUAL HEADED RAZOR ASSEMBLY

[76] Inventor: Daniel Sokoloff, 1000 45th St., Suite #1, West Palm Beach, Fla. 32960

[21] Appl. No.: 494,982

[22] Filed: Mar. 16, 1990

[51] Int. Cl.[5] ..... B26B 19/06

[52] U.S. Cl. ..... 30/34.1; 30/40.2

[58] Field of Search ..... 30/32, 34.1, 48, 49, 30/50, 85, 86, 89, 40.2

[56] References Cited

U.S. PATENT DOCUMENTS 4,285,124 8/1981 Diakonov ..... 30/34.1

4,309,821 1/1982 Terry et al. ..... 30/32

4,432,136 2/1984 Taylor ..... 30/32

4,785,534 11/1988 Lazarchik ..... 30/50

*Primary Examiner*—Douglas D. Watts

*Attorney, Agent, or Firm*—Eckert, Seamans, Cherin & Mellott

[57] ABSTRACT

A razor assembly includes dual razor heads mounted on a single handle. One razor head is adapted to hold a conventional size blade. The other razor head is adapted to hold a much smaller blade for convenient shaving around one's nostrils and for trimming of moustaches, beards and sideburns. The user can choose between either razor head simply by rotating the handle with his fingers.

25 Claims, 2 Drawing Sheets

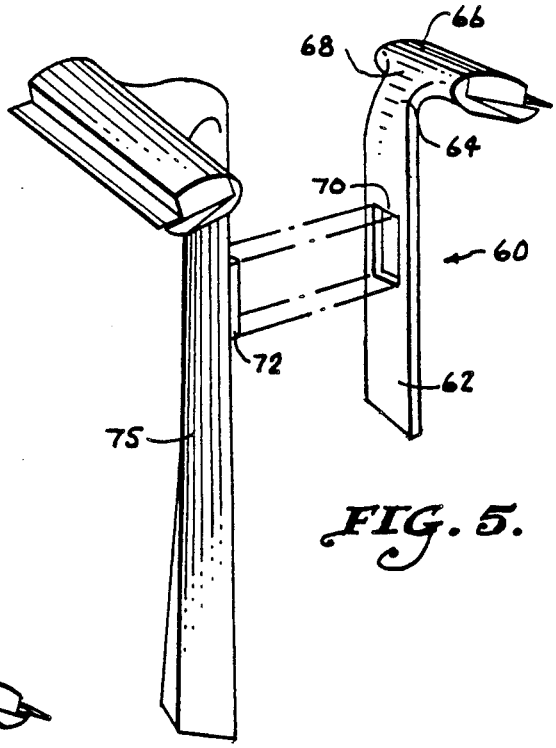
FIG. 5.
FIG. 6.
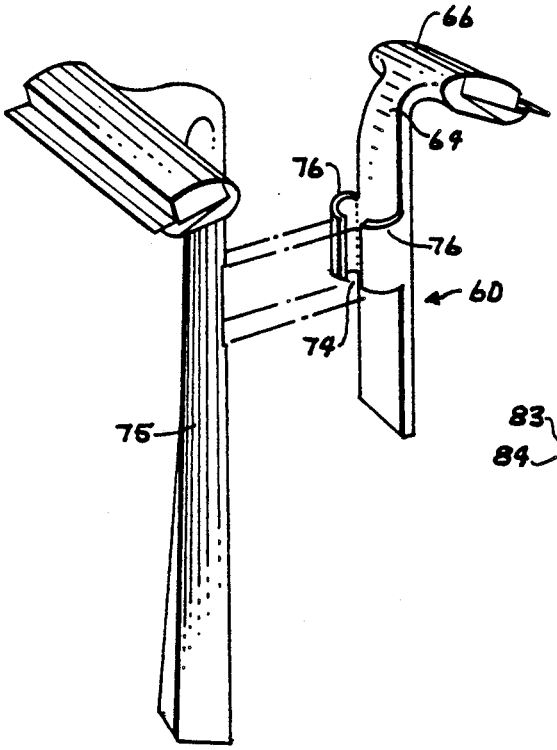
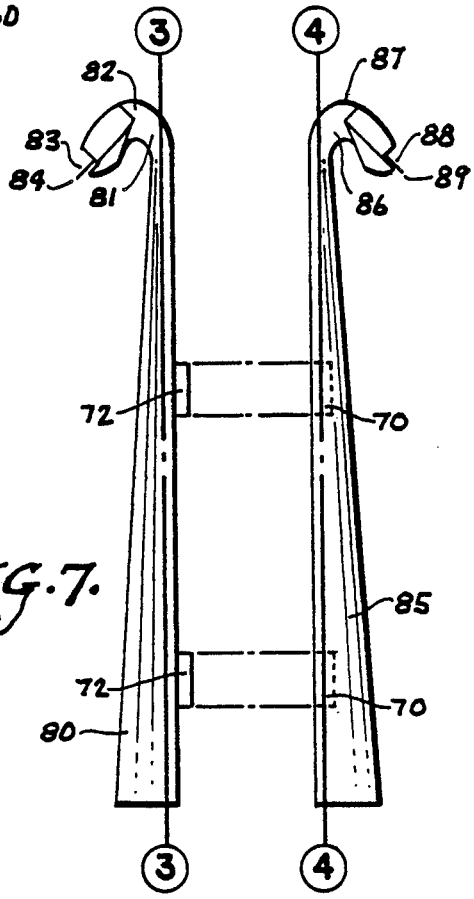
FIG. 7.

DUAL HEADED RAZOR ASSEMBLY

BACKGROUND OF THE INVENTION 1. Field of the Invention

This invention relates to the field of razor assemblies, and in particular to a razor assembly having two separate razor heads, wherein one head holds a conventional size blade and the other head holds a much smaller blade for shaving in confined areas, especially around the nostrils.

2. Prior Art

A conventional razor for shaving facial hair has a shaving head with a blade which is approximately one and a half inches in length along its cutting edge. Such a razor may contain more than one blade and/or more than one cutting edge. Two blades may be mounted one behind the other for the purpose of producing a closer shave while using less strokes of the razor.

In another embodiment, a shaving head houses a single blade which has two cutting edges disposed on opposite sides of the shaving head. This embodiment results in a shaving head which is larger than the shaving head for a single edge blade. The advantage of the double edge blade is in the reduced need to change blades because a blade with two cutting edges should last twice as long.

Regardless of the number of blades or cutting edges, a razor having a conventional size cutting edge is best suited for shaving broad, relatively flat areas such as the sides of the face or below the chin. Such a razor is difficult to use in areas where there are folds in the skin, particularly in the area around the nostrils, or for precise trimming of moustaches, beards, etc. The cutting edge of a conventional razor is longer than desirable for such shaving, with the result that the user must use extra care in handling the razor, stretch the skin and distort the face to gain access, and suffer razor nicks in the process. Clearly, a razor with a shorter cutting edge would be preferred for shaving in certain areas. However, the inconvenience of having two separate razor assemblies makes this idea unattractive. What is needed is a razor assembly which will overcome this problem.

Dual element razor assemblies are known. U.S. Pat. No. 4,501,066 to Sceberras discloses a dual headed razor having a handle supporting a pair of identical razor heads. The razor heads are mounted so that they contact the skin simultaneously but face in opposite directions, thus permitting a shaving action in both forward and rearward strokes. Sceberras does not disclose a smaller blade for precision shaving.

U.S. Pat No. 4,461,078 to Carreker discloses a dual headed razor with different size heads. Each head is mounted on a separate handle portion, and the handle portions are pivotally mounted to each other. When in operable condition, the razor heads are at opposite ends of a relatively long handle, making the device cumbersome. The length of the handle in operable condition must be relatively long, lest the user risk holding the handle too near one of the razor heads and suffering hand cuts. A simple yet versatile shaving device is needed to overcome these problems.

SUMMARY OF THE INVENTION

It is an object of the invention to provide a razor assembly which is more versatile than a conventional single head razor.

It is another object of the invention to provide a razor assembly which facilitates shaving in the area around the nostrils.

It is a further object of the invention to provide a razor assembly which facilitates trimming of moustaches, beards and sideburns.

It is still another object of the invention to provide a razor assembly which is simple and easy to use.

These and other objects of the invention are accomplished by a razor assembly having two razor heads mounted on one end of a single handle. The razor heads and their attendant cutting blades are of different sizes, and the razor heads are mounted such that their cutting blades face in opposite directions. The user having employed one cutting blade can select the other cutting blade by simply rotating the handle in his fingers 180°, and can similarly select either cutting blade at any time.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein:

FIG. 5 is a perspective view of a removable razor head support and means for attaching to a razor.

FIG. 6 is a perspective view of a removable razor head support and another means for attaching to a razor.

FIG. 7 is a side elevation view of a razor assembly according to the invention and having two razor handles.

DETAILED DESCRIPTION OF THE PREFERRED EMBODIMENTS

Figure 3:
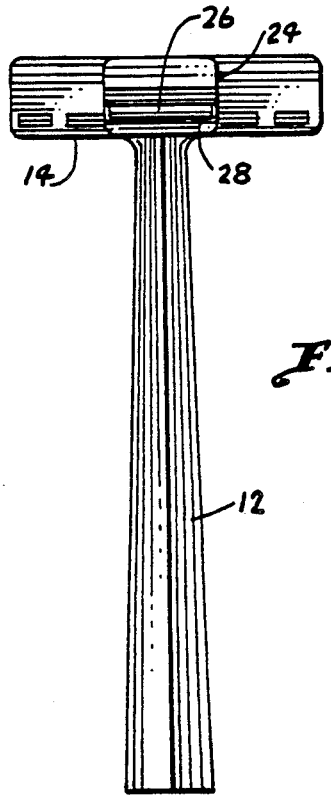
FIG. 3 is a front elevation view of the razor assembly according to the invention.
Figure 2:
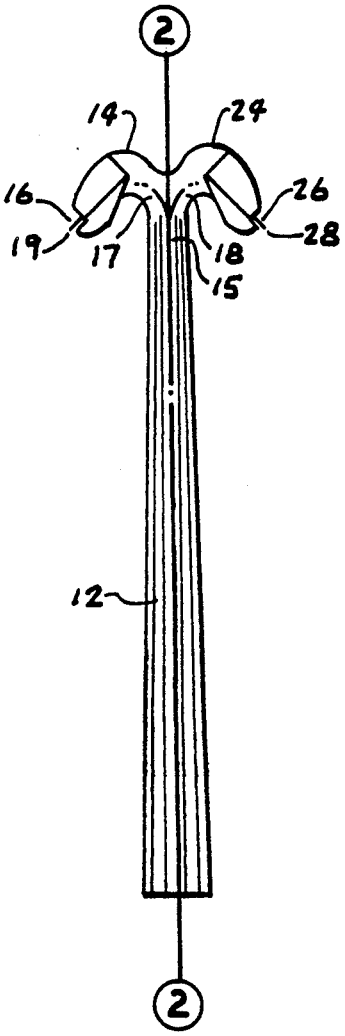
FIG. 2 is a side elevation view of a razor assembly according to the invention.

A razor assembly according to the invention as shown in FIGS. 2 and 3 has an elongated handle 12 having an elongation axis 2—2 in the direction of the elongation. A razor head support 15 is attached to the handle at one end. The razor head support 15 is adapted to hold two razor heads. Head support 15 may comprise a pair of stubs 17, 18 protruding from the elongated handle 12. Each stub 17, 18 is adapted to hold a single razor head.

A long razor head 14 is attached to the end of stub 17. The long razor head 14 is adapted to hold a long razor blade 16 having a long cutting edge 19 such that the long cutting edge 19 is perpendicular to elongation axis 2—2 and disposed at a distance therefrom.

Figure 1:
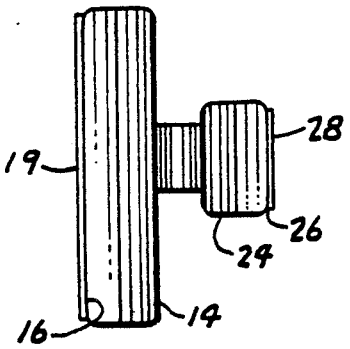
FIG. 1 is a top view of a razor assembly according to the invention, showing the relative orientation of the two razor heads.

A short razor head 24 is attached to stub 18. The short razor head 24 is adapted to hold a short razor blade 26 having a short cutting edge 28. As shown in FIG. 2, the short cutting edge 28 is parallel to the long cutting edge 18 and is disposed at a distance from the elongation axis 2—2 on a side opposite from the long cutting edge 18. The long and short cutting edges have unequal lengths, as shown in FIG. 1.

The razor assembly according to the invention is used in the conventional manner by applying the long cutting edge 19 to the face in order to shave large areas. When the user desires to employ the short cutting edge 28 he simply rotates the handle 12 180° between his thumb and fingers.

The short cutting edge 28 can then be applied for precise trimming of a beard, moustache or sideburns, and for shaving the confined areas around the nostrils. Thus, the user can repeatedly select either cutting edge by a simple rotation of the handle which is easily done with one hand. The other hand is always free to manipulate the facial skin if necessary. Also, since the free hand need not contact the razor in order to employ a different blade, there is virtually no chance of getting a hand cut from accidental contact with a cutting edge.

Figure 4:
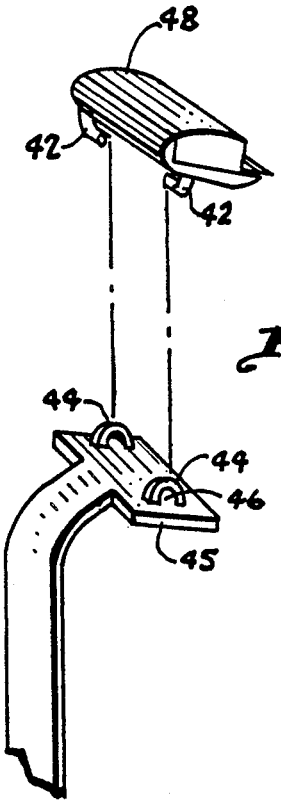
FIG. 4 is a perspective view of a removable razor head according to the invention.

The individual razor heads may be removable. Removable razor heads are known in the art. These may snap onto the head support 45 as shown in FIG. 4. Short pegs 42 on the underside of the razor head 48 have a separation between them. Ears 44 on the end of head support 45 have a slightly larger separation than that between short pegs 42. Ears 44 have pockets 46 which accept short pegs 42 when short pegs 42 are forced over ears 44. The razor head 48, and the head support 45 are made of a semi-rigid material which accepts a slight resilient bending when short pegs 42 are snapped into place.

The razor heads may also be pivotally attached. Short pegs 42 fit loosely into pockets 44 so that short pegs 42 are free to rotate. Razor head 48, having short pegs 42 in pockets 44 can pivot through a rotation angle of approximately 30°. Pivotal attachment allows the razor heads to better follow the contours of the face and results in a more comfortable shave while preventing nicks to the user.

The head support may be a separable unit. As shown in FIG. 5, head support 60 has a body 62 having attachment means for removably attaching the head support 60 to a razor 75. A stub 64 protruding from the body 62 is adapted to hold a razor head 66 at a distal end 68 of the stub 64. The attachment means may comprise a recess 70 which is adapted to receive a mounting lug 72 on a razor 75 in an interference fit. The recess 70 may have resiliently expansible sides which provide a secure attachment while allowing easy removal of the head support from the razor 75. Conversely, the lug 72 may have resiliently compressible sides. In another embodiment, shown in FIG. 6, the attachment means comprises a clamp 74 attached to the body 62. The clamp has resiliently expansible sides 76 which are separated to allow the insertion of a razor handle between them. The resilient nature of the sides 76 causes them to firmly grip the razor 75. The head support 60 can be removed from the razor 75 by applying a force between the razor 75 and the head support 60.

A dual headed razor assembly according to the invention may also comprise a pair of single head razors, each with a different size shaving head, attached to each other. As shown in FIG. 7, a first elongated handle 80 has a first elongation axis 3—3. A first head support 81 is disposed at one end of the first elongated handle 80. A first razor head 82, attached to the first head support, is adapted to hold a first razor blade 83 having a first cutting edge 84 such the first cutting edge 84 is perpendicular to the first elongation axis 3—3 and disposed at a distance therefrom.

A second elongated handle 85 has a second elongation axis 4—4. A second head support 86 is disposed at one end of the second elongated handle 85. A second razor head 87, attached to the second head support 86, is adapted to hold a second razor blade 88 having a second cutting edge 89 such that the second cutting edge 89 is perpendicular to the second elongation axis 4—4 and disposed at a distance therefrom. The first cutting edge 84 and second cutting edge 89 have different lengths.

The second elongated handle 85 is removably attached to the first elongated handle 80 such that the second elongation axis 4—4 is substantially parallel to the first elongation axis 3—3. The attachment means may comprise the lug 72 and recess 70 as shown in FIG. 7, or the clamp 74 with resiliently expansible sides as shown in FIG. 6.

I claim:

1. A razor assembly comprising:

an elongated handle having an elongation axis in the direction of elongation;

a head support means disposed at one end of the elongated handle, said head support means adapted to hold at least two razor heads;

a first razor head attached to the head support means, said first razor head adapted to hold a first razor blade having a first cutting edge such that the first cutting edge is perpendicular to said elongation axis and disposed at a distance therefrom, and;

a second razor head attached to the head support means, said second razor head adapted to hold a second razor blade having a second cutting edge such that the second cutting edge is parallel to the first cutting edge and is disposed at a distance from the elongation axis on a side opposite from the first cutting edge, and wherein the first and second cutting edges have different characteristics.

2. The razor assembly as defined in claim 1, wherein the head support means is removably attached to the elongated handle.

3. The razor assembly as defined in claim 1, wherein at least one of the razor heads is removably attached to the head support means.

4. The razor assembly as defined in claim 1, wherein at least one of the razor heads is pivotally attached to the head support means.

5. The razor assembly as defined in claim 1, wherein the head support means comprises a first head support and a second head support.

6. The razor assembly as defined in claim 5, further comprising attachment means whereby at least one of the first and second head supports is removably attached to the elongated handle.

7. The razor assembly as defined in claim 5, wherein the first and second head supports comprise a pair of stubs protruding from the elongated handle.

8. The razor assembly as defined in claim 6, wherein said attachment means comprises at least one mounting lug protruding from the elongated handle, and wherein the at least one of the first and second head supports has at least one recess adapted to receive said at least one mounting lug in an interference fit.

9. The razor assembly as defined in claim 8, wherein said at least one mounting lug has resiliently compressible sides.

10. The razor assembly as defined in claim 8, wherein said at least one recess has resiliently expansible sides.

11. The razor assembly as defined in claim 6, wherein the at least one of the first and second head supports comprises at least one resiliently expansible clamp adapted to receive the elongated handle in an interference fit.

12. A removable razor head support comprising:

a body having attachment means for removably attaching in a first direction said removable head support to a razor;

a stub protruding from the body and adapted to hold a razor head at a distal end of said stub;

a razor head attached to said distal end extending in a second direction opposite to said first direction and adapted to hold a razor blade having a cutting edge.

13. The removable razor head support as defined in claim 12, wherein the razor head is removably attached to the distal end.

14. The removable razor head support as defined in claim 12, wherein the razor head is pivotably attached to the distal end.

15. The removable razor head support as defined in claim 12, wherein said attachment means comprises at least one recess adapted to receive at least one mounting lug on a razor in an interference fit.

16. The removable razor head support as defined in claim 15, wherein the at least one recess has resiliently expansible sides.

17. The removable razor head support as defined in claim 12, wherein said attachment means comprises at least one resiliently expansible clamp adapted to mount on a razor in an interference fit.

18. A razor assembly comprising:

a first elongated handle having a first elongation axis in the direction of elongation;

a first head support means disposed at one end of the first elongated handle, said first head support means adapted to hold a first razor head;

a first razor head attached to the first head support means, said first razor head adapted to hold a first razor blade having a first cutting edge such that the first cutting edge is perpendicular to the first elongation axis and disposed at a distance therefrom;

a second elongated handle having a second elongation axis in the direction of elongation;

a second head support means disposed at one end of the second elongated handle, said second head support means adapted to hold a second razor head;

a second razor head attached to the second head support means, said second razor head adapted to hold a second razor blade having a second cutting edge such that the second cutting edge is perpendicular to the second elongation axis and disposed at a distance therefrom;

attachment means whereby said second elongated handle is removably attached to an outer surface of said first elongated handle such that said first and second elongation axes are substantially parallel, and;

wherein the first cutting edge and second cutting edge have different characteristics.

19. A razor assembly as defined in claim 18, wherein at least one of said first and second razor heads is removably attached to one of said first and second head support means.

20. A razor assembly as defined in claim 18, wherein at least one of said first and second razor heads is pivotally attached to one of said first and second head support means.

21. A razor assembly as defined in claim 18, wherein at least one of said first and second head support means comprises a stub protruding from one of said first and second elongated handles.

22. A razor assembly as defined in claim 18, wherein said attachment means comprises at least one mounting lug protruding from one of the first and second elongated handles, and wherein the other of said first and second elongated handles has at least one recess adapted to receive said at least one mounting lug in an interference fit.

23. A razor assembly as defined in claim 22, wherein said at least one mounting lug has resiliently compressible sides.

24. A razor assembly as defined in claim 22, wherein said at least one recess has resiliently expansible sides 25. A razor assembly as defined in claim 18, wherein said attachment means comprises at least one resiliently expansible clamp attached to at least one of the first and second elongated handles, and wherein said at least one resiliently expansible clamp is adapted to receive the other of the first and second elongated handles in an interference fit.

* * * * *